US006032792A

United States Patent [19]

Faraj

[11] Patent Number: 6,032,792

[45] Date of Patent: Mar. 7, 2000

[54] SMOKER'S BOX

[76] Inventor: Abdul-Razzak Faraj, P.O. Box 566068, Atlanta, Ga. 31156

[21] Appl. No.: 09/229,196

[22] Filed: Jan. 13, 1999

[51] Int. Cl.[7] ..... A24F 15/00

[52] U.S. Cl. ..... 206/246; 206/236; 206/242; 206/261

[58] Field of Search ..... 206/242, 245, 206/246, 248, 256–258, 261, 264–266, 236

[56] References Cited

U.S. PATENT DOCUMENTS 1,398,059 11/1921 Bayuk ..... 206/246
1,646,632 10/1927 Spinner ..... 206/246
1,651,177 11/1927 Bowyer ..... 206/246
2,653,614 9/1953 Coffey ..... 206/246

*Primary Examiner*—Paul T. Sewell
*Assistant Examiner*—Jila M. Mohandesi
*Attorney, Agent, or Firm*—John L. James

[57] ABSTRACT

A smoker's box has a base with sidewalls and end walls attached to it forming a boxy structure. Panels divide the boxy structure into compartments for holding cigarettes and other articles needed by a smoker. A lid has a top panel hingedly connected to one end wall and has a downwardly extending lip for engaging another end wall to inhibit air infiltration to help keep the cigarettes fresh. The lid contains a cover for the ashtray which engages the ashtray when the lid is closed to prevent ashes from spilling.

11 Claims, 2 Drawing Sheets

SMOKER'S BOX

FIELD OF THE INVENTION

The present invention relates generally to smoker's articles, and, ore particularly, to a box for holding an ashtray, cigarettes and a lighter, matches or other items used by smokers.

BACKGROUND OF THE INVENTION

It has become socially unacceptable and often unlawful to smoke in many public buildings and work places. In many instances, it is also undesirable to encourage smoking in the home or automobile. While many home owners do not strenuously object if someone smokes in the home or automobile, ashtrays are no longer part of the home decor and are vanishing creating a problem with ash and debris disposal. In the workplace and in public buildings, smokers usually have an area designated for smoking that is often located outside the building. While smoking areas are provided, ashtrays are not always provided for disposing of ashes and other debris. To use these designated smoking areas, a smoker has to carry the cigarettes along with matches and an ashtray if the smoker wants to be tidy and not leave ashes sprawled about. Many times a smoker will leave his office and journey to the designated area only to find that he has forgotten his matches or lighter or has forgotten to bring an ashtray. Accordingly, it will be appreciated that it would be highly desirable to have a convenient container for carrying the smoker's articles including a supply of cigarettes, a lighter or matches and an ashtray for collecting ashes and other debris. It is desirable to have the articles stored together in a convenient to carrying container that can fit into a purse or pocket or can easily fit onto an automobile seat.

SUMMARY OF THE INVENTION

Briefly summarized, according to one aspect of the present invention, a smoker's box comprises a base having first and second end portions; a plurality of upstanding panels attached to the base defining a cigarette compartment for cigarettes, a lighter compartment for a cigarette lighter or matches and an ashtray compartment for an ashtray; a first end wall extending upward from the first end portion of the base and defining a slot on a distal end portion of the first end wall; a second end wall extending upward from the first end portion of the base and spaced a preselected distance from the first end wall; a third end wall extending upward from the second end portion of the base and defining a groove; a lid having a top panel and an end panel extending downwardly from the top panel, the end panel engaging the third end panel of the base to inhibit air infiltration; a curved member attached to the lid and protruding through the slot in the first end wall forming a hinge between the lid and the first end wall; and a coil spring attached to the base and lid and extending between the base and lid.

The spring and curved member facilitate opening and closing the lid. The spring biases the lid closed and the curved member slides in the slot so that the lid remains open against the force of the spring. The second end wall inhibits air infiltration on one end while the third end wall inhibits air infiltration on the other end.

The box has a plurality of panels dividing the interior of the box into a number of compartments. One compartment is for holding a package of cigarettes while another holds a lighter or matches. An ashtray compartment has an ashtray in it with a handle for removing and inserting the ashtray. The box has a lid with a cover for the ashtray to prevent ashes from spilling when the lid is closed and the box is being transported.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
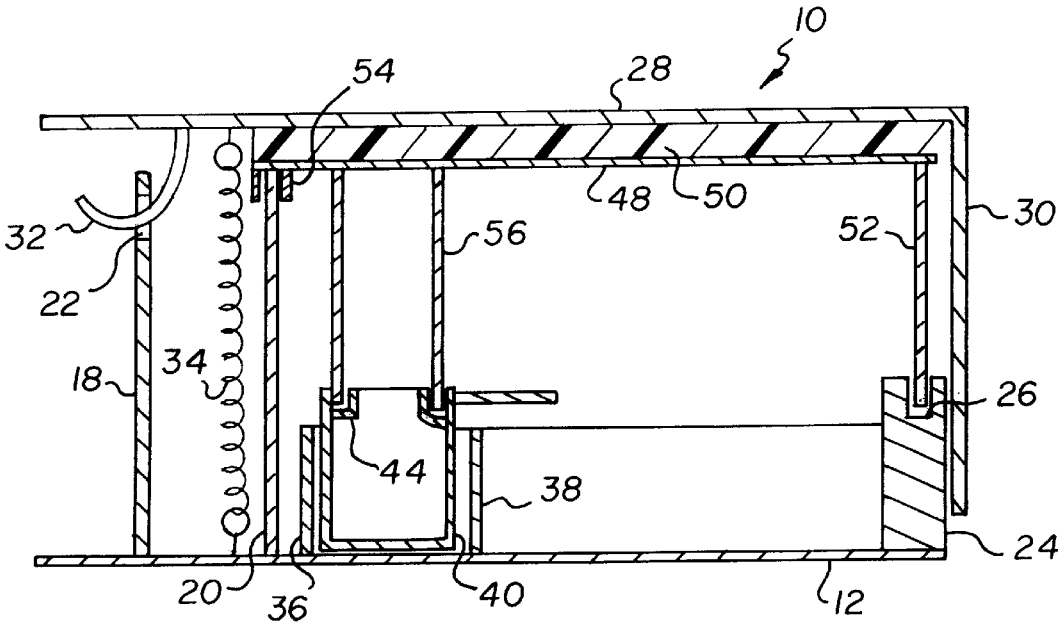
FIG. 1 is a diagrammatic longitudinal sectional view taken along line 1—1 of FIG. 3 of a preferred embodiment of a smoker's box according to the present invention.
Figure 3:
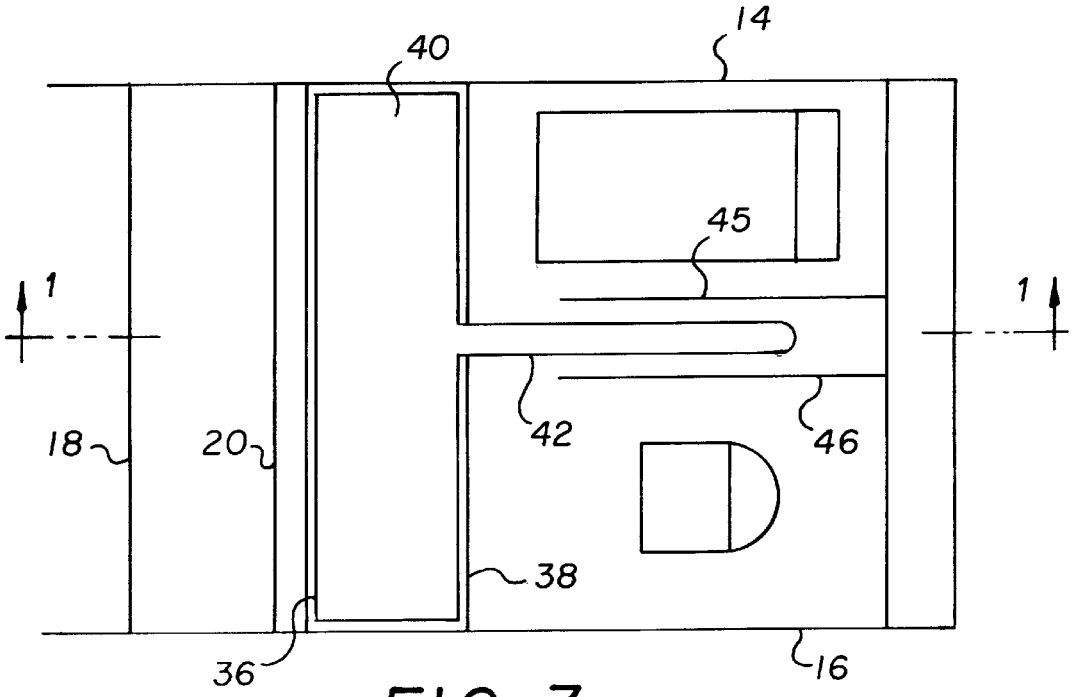
FIG. 3 is a diagrammatic top view of the smoker's box of FIGS. 1 and 2 with the lid removed showing the ashtray and other articles in the box.
Figure 2:
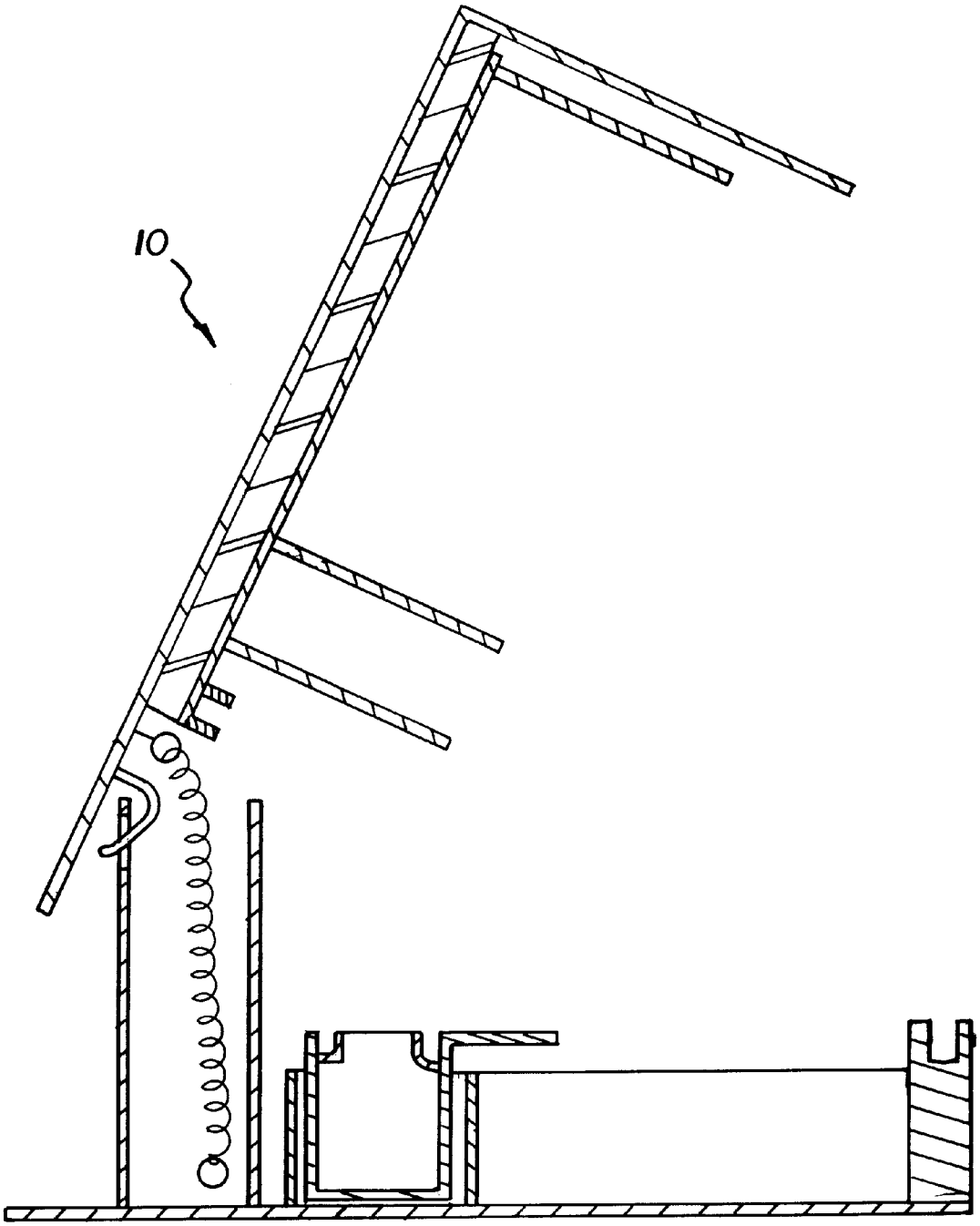
FIG. 2 is a sectional view similar to FIG. 1 but showing the box with the lid open.

Referring to FIGS. 1–3, a smoker's box 10 has base 12 that forms the bottom of the box 10. A first sidewall 14 rises from the base 12 and extends upward. Similarly, a second sidewall 16 rises from the base and extends upwards parallel to the first sidewall. A first end wall 18 extends upward from one end portion of the base 12, and a second end wall 20, spaced a small distance from the first end wall 18, also extends upward from the same end portion of the base 12. A slot 22 is formed in a distal end portion of the first end wall 18. The first and second end walls 18, 20 are connected to the first and second sidewalls 14, 16. A third end wall 24 extends upward from its bottom edge where it is attached to the other end portion of the base and extends between the sidewalls 14, 16. A receiving groove 26 is formed in a top edge of the third end wall. The sidewalls and end walls form an open boxy structure with the base.

An exterior lid for the smoker's box has a top panel 28 and an end panel 30 extending downwardly from the top panel 28. End panel 30 engages the third end wall 24 to inhibit air infiltration when the exterior lid is closed. As illustrated, the end panel 30 of the lid overlaps and abuts the third end wall 24. Felt or other material may line end panel 30 to form a gasket or seal to prevent air infiltration to keep the cigarettes fresh.

A curved member 32 is attached to the lid and protrudes through slot 22 in the first end wall 18 forming a hinge between the lid and the first end wall. The lid pivots between an open position and a closed position. In the closed position, curved member protrudes through slot 22 towards the rear of the box. First end wall 18 is preferably offset from the very end of the base member and curved member 32 is offset from the very end on the lid so that the curved member does not protrude from the end of the box where it could be noticed or otherwise in the way. In the open position, the distal end of the curved member is withdrawn toward the first end wall 18 so that its protrusion is minimized. As the lid is opened, the pivot point shifts so that the lid can come to rest with the top portion of end wall 18 that is above slot 22 between the curved member 32 and top panel 28 of the lid. In this position the lid remains stationary so that it is not necessary to hold it open with a hand while accessing materials in the box. First end wall 18 may be shorter in height than second end wall 20 so that the lid is lifted slightly as it pivots. The curved member is preferably metal while the other components of the smoker's box can be constructed of wood or plastic. Wood is preferable because it insulate the cigarettes against abrupt changes in temperature encountered when a smoker goes from an air conditioned building to the outside. A wooden box tends to inhibit condensation not only by insulating but also by its ability to absorbs small amounts of moisture that could ruin a cigarette. Wood can be carved for aesthetic appeal.

A coil spring 34 extending between the base and lid biases the lid closed. The spring 34 can be attached to the base and lid with hooks. Spring 34 is preferably positioned between the first and second end walls 18, 20 so that it is out of sight and does not interfere with the smoker's articles in the box.

The interior of the smoker's box is completed by installing a plurality of upstanding panels to divide the interior into compartments for cigarettes, matches and an ashtray. An ashtray compartment is formed by panels 36 and 38 which extend from the first sidewall 14 to the second sidewall 16 forming a rectangular compartment for an ashtray 40. Ashtray 40 has a handle 42 for inserting and removing the ashtray from the compartment. Ashtray 40 has sidewalls that define a peripheral groove 44 for receiving an ashtray cover. The height of the ashtray may less than the height of the panels 36, 38 forming its compartment, or the height of the ashtray may be greater. Handle 42 can be formed to accommodate either situation, or panel 38 may have an opening for the handle 42 to protrude through. While the ashtray may be a one-piece item, a two piece ashtray with the handle being a separate item could also be used, As illustrated, panels 36 and 38 extend the full width of the box between the sidewalls, but a smaller compartment less than the width of the box could be used. The spaced thus saved could be utilized for extra matches or perhaps a container of air freshener or even lipstick. Also, where the box is to be used for cigars, a smaller ashtray compartment is preferred so that a cigar can be positioned to extend lenghtwise between the second and third end walls 20, 24.

A panel 45 extending along the base forms a cigarette compartment along with sidewall 14, third end wall 24 and panel 38. Panel 45 may extend the entire length between panel 38 and third end wall 24, or may extend only part way. Another panel 46 extends along the base to form a cigarette lighter or match compartment along with sidewall 16, third end wall 24 and panel 38. Panel 46 may extend the entire length between panel 38 and third end wall 24, or may extend only part way. Panels 45 and 46 are spaced from one another and the ash tray handle 42 extends into the open space between them. Where the ashtray does not have a protruding handle 42 one panel is sufficient to form both the cigarette and lighter compartments. To minimize the overall dimensions of the smoker's box, the compartments are made to accommodate a standard sized cigarette box or package and a disposable butane cigarette lighter, the ashtray is selected to fit the width thus obtained. Where dual compartment forming panels are used, the ashtray handle can be offset to one side; it need not be centered.

An interior cover or lid 48 can attached to the top panel 28 of the exterior lid with glue or other adhesive. Preferably lid 48 is attached to an elastomeric material 50 which is attached to the top panel 28 of the exterior lid. The interior lid 48 has a top panel to which the elastomeric material 50 is attached and an end panel 52 that extends downwardly from the top panel for engaging the receiving groove 26 third end wall 24. Interior lid 48 also has a groove panel 54 that has a groove for engaging the second end wall 20. When the lid are closed, the interior lid engages the second and third end panels forming a seal to inhibit air infiltration thereby keeping the cigarettes in a fresh and ready state.

Also attached to the top panel of the interior lid 48 is an ashtray cover 56. Preferably, ashtray cover 56 has panels extending downwardly that engage groove 44 about the sidewalls of the ashtray to prevent ashes from spilling when the lids are closed. Elastomeric material 50 provides a cushioning effect ensuring that components are not damaged when the lids are closed even if the panels bottom out in the grooves.

Operation of the present invention is believed to be apparent from the foregoing description and drawings, but a few words will be added for emphasis. The lid is swung open exposing the interior of the box and is held open against the force of the spring while the smoker chooses a cigar or cigarette. The selected item is lighted using the lighter or match provided in the box. Ashes or other debris is deposited in the ashtray. When finished smoking, the user deposits the butt in the ashtray and closes the lid whereby the ashtray cover covers the ashtray in an air tight manner without contaminating the remaining cigarettes. When it is convenient, the lid is opened to empty the ashtray.

It can now be appreciated that a smoker's box has been presented that provides a convenient place for storing cigarettes along with an ashtray, and a lighter or matches so that a smoker has all the items needed when the opportunity to smoke arises. The lid of box is pivoted open position and holds itself open so that the ashtray is available while smoking. The lid closes to store the smoking material along with ashes and other debris. without spilling the ashes. The box can be made just large enough to house the needed articles whereby it is small enough to fit into a purse or pocket. Such a size need only be slightly larger than a standard cigarette package. On the other hand, the box can be larger, like a shoe box, to fit on a desk and to display decorative artwork. The box can be made like a humidor so that cigars, cigarettes or pipe tobacco remain fresh for several days and butts are encouraged to quickly extinguish. Aesthetically enhancing the box makes it less obtrusive when sitting on a desk awaiting use.

While the invention has been described with particular reference to the preferred embodiments, it will be understood by those skilled in the art that various changes may be made and equivalents may be substituted for elements of the preferred embodiments without departing from invention. For example, while the box may be either ceramic, plastic, wood or metal, carved wood enhances aesthetic appeal and adds richness while being extremely durable. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. For example, the compartment for holding matches can be eliminated and the matches stored in the cigarette package compartment. It is accordingly intended that the claims shall cover all such modifications and applications as do not depart from the true spirit and scope of the invention.

What is claimed is:

1. A smoker's box, comprising:

a base having first and second end portions;

a first sidewall extending upward from said base;

a second sidewall extending upward from said base and spaced from said first sidewall;

a first end wall extending upward between said first and second sidewalls from said first end portion of said base and defining a slot on a distal end portion of said first end wall;

a second end wall extending upward between said first and second sidewalls from said first end portion of said base and spaced a preselected distance from said first end wall;

a third end wall extending upward between said first and second sidewalls from said second end portion of said base;

a lid having a top panel and an end panel extending downwardly from said top panel, said end panel engaging said third end wall to inhibit air infiltration;

a curved member attached to said lid and protruding through said slot in said first end wall forming a hinge between said lid and said first end wall;

a coil spring attached to said base and lid and extending between said base and lid;

a plurality of upstanding panels attached to said base between said first and second sidewalls and said second and third end walls defining a cigarette compartment for cigarettes, a lighter compartment for a cigarette lighter or matches and an ashtray compartment for an ashtray;

an ashtray having sidewalls and being removably positioned in said ashtray compartment;

an ashtray cover attached to said lid, said ashtray cover engaging said sidewalls of said ashtray to prevent ashes from spilling when said lid is closed.

2. A smoker's box, as set forth in claim 1, wherein said ashtray has a handle extending from said ashtray towards said third end wall.

3. A smoker's box, comprising:

a base having first and second end portions;

a plurality of upstanding panels attached to said base defining a cigarette compartment for cigarettes, a lighter compartment for a cigarette lighter or matches and an ashtray compartment for an ashtray;

a first end wall extending upward from said first end portion of said base and defining a slot on a distal end portion of said first end wall;

a second end wall extending upward from said first end portion of said base and spaced a preselected distance from said first end wall;

a third end wall extending upward from said second end portion of said base and defining a groove;

a lid having a top panel and an end panel extending downwardly from said top panel, said end panel engaging said third end panel of said base to inhibit air infiltration;

a curved member attached only to said lid and protruding through said slot in said first end wall forming a hinge between said lid and said first end wall; and a coil spring attached to said base and lid and extending between said base and lid.

4. A smoker's box, as set forth in claim 3 including an interior cover attached to said lid, said cover having a top panel, an end panel extending downwardly from said top panel for engaging said third end panel groove, and a groove panel having a groove for engaging said second end wall.

5. A smoker's box, as set forth in claim 4, including an elastomeric member between said lid and said interior cover.

6. A smoker's box, as set forth in claim 3 including an ashtray removably positioned in said ashtray compartment.

7. A smoker's box, as set forth in claim 6, wherein said ashtray has a handle extending from said ashtray towards said third end wall.

8. A smoker's box, as set forth in claim 3, including:

an interior cover attached to said lid;

an ashtray removably positioned in said ashtray compartment, said ashtray having sidewalls defining a groove about said sidewalls of said ashtray; and an ashtray cover attached to said interior cover, said ashtray cover engaging said groove about said sidewalls of said ashtray to prevent ashes from spilling when said lid is closed.

9. A smoker's box, comprising:

a base having first and second end portions;

a plurality of upstanding panels attached to said base defining a cigarette compartment for cigarettes, a lighter compartment for a cigarette lighter or matches and an ashtray compartment for an ashtray;

an ashtray removably positioned in said ashtray compartment, said ashtray having sidewalls defining a groove about said sidewalls;

a first end wall extending upward from said first end portion of said base and defining a slot on a distal end portion of said first end wall;

a second end wall extending upward from said first end portion of said base and spaced a preselected distance from said first end wall;

a third end wall extending upward from said second end portion of said base and defining a groove;

an external lid having a top panel and an end panel extending downwardly from said top panel, said end panel lying adjacent and overlapping said third end panel of said base;

a curved member attached to said external lid and protruding through said slot in said first end wall forming a hinge between said external lid and said first end wall;

a coil spring attached to said base and external lid and extending between said base and external lid;

an interior lid attached to said exterior lid, said interior lid having a top panel, an end panel extending downwardly from said top panel for engaging said third end panel groove, and a groove panel having a groove for engaging said second end wall; and an ashtray cover attached to said interior lid, said ashtray cover engaging said groove about said sidewalls of said ashtray to prevent ashes from spilling when said lids are closed.

10. A smoker's box, as set forth in claim 9, wherein said ashtray has a handle extending from said ashtray towards said third end wall.

11. A smoker's box, as set forth in claim 9, including an elastomeric member between said interior and exterior lids.

* * * * *